US007020939B2

(12) United States Patent
Anscher

(10) Patent No.: US 7,020,939 B2
(45) Date of Patent: Apr. 4, 2006

(54) SEPARABLE BUCKLE

(76) Inventor: Joseph Anscher, 1928 Midlane, Muttontown, NY (US) 11791

( * ) Notice: Subject to any disclaimer, the term of this patent is extended or adjusted under 35 U.S.C. 154(b) by 0 days.

(21) Appl. No.: 10/830,775

(22) Filed: Apr. 23, 2004

(65) Prior Publication Data

US 2005/0235469 A1 Oct. 27, 2005

(51) Int. Cl.
*A44B 11/26* (2006.01)

(52) U.S. Cl. ..... 24/625

(58) Field of Classification Search ..... 24/614–616, 24/625; D11/216
See application file for complete search history.

(56) References Cited

U.S. PATENT DOCUMENTS

D402,919 S 12/1998 Anscher
5,926,928 A * 7/1999 Lundstedt ..... 24/625
6,449,818 B1 * 9/2002 Fildan et al. ..... 24/578.1
6,457,219 B1 * 10/2002 Liu ..... 24/625
D468,233 S * 1/2003 Della Valle ..... D11/216
D484,070 S * 12/2003 Buscart ..... D11/216
2002/0040514 A1 * 4/2002 Uehara et al. ..... 24/614

FOREIGN PATENT DOCUMENTS

JP 09206113 A * 8/1997

OTHER PUBLICATIONS

U.S. Appl. No. 10/713,311 filed Nov. 14, 2003.

* cited by examiner

*Primary Examiner*—James R. Brittain
(74) *Attorney, Agent, or Firm*—Collard & Roe, P.C.

(57) ABSTRACT

A buckle comprising a female part having a hollow body with a front wall, a back wall, an open top, a cavity between the top and bottom walls and at least one locking slot extending through the hollow body and communicating with the cavity. The top and bottom walls have a cutout that communicates with the open top. There is a male part that has a base, at least one locking leg and a central leg. The central leg has a shape that corresponds to the shape of the cutout in the female part. The central leg also has a mesh portion that reduces the weight of the buckle. Inserting the male part into the open top of the female part causes the central leg to rest in the cutout of the female part and the locking leg to engage the locking slot to lock the male part to the female part.

9 Claims, 3 Drawing Sheets

SEPARABLE BUCKLE

BACKGROUND OF THE INVENTION

1. Field of the Invention

The invention relates to a two-piece buckle suitable for connecting two straps together. In particular, the invention relates to a side-release type buckle in which the female portion has a large cutout for engaging an enlarged center prong on the male portion.

2. The Prior Art

A typical side-release buckle consists of a female part having a hollow cavity, and a male part, having three prongs that insert into the female portion. The two outside prongs extend through locking tabs on the female portion to secure the two portions together. An example of this type of buckle is shown in U.S. Design Pat. No. D402,919 to Anscher.

In the typical buckle, the female part has solid side walls that receive the male part between them. This requires that the male part be inserted perfectly straight into the female part fo the parts to be engaged. Tilting of either of the parts prevents insertion of the male part into the female part. This can make locking the buckle difficult in situations where the user and/or the buckle are moving.

A buckle having a portion formed of a mesh or screen in shown in U.S. patent application Ser. No. 10/713,311, the disclosure of which is herein incorporated by reference. The screen portion decreases the weight of the buckle without decreasing its strength and durability, and also contributes to its appearance.

SUMMARY OF THE INVENTION

It is therefore an object of the invention to provide two-piece buckle that can be easily locked, even when the buckle or user is moving.

It is another object of the invention to provide a buckle that is light weight and aesthetically pleasing.

It is yet another object of the invention to provide a buckle that is simple and inexpensive to manufacture.

These and other objects of the invention are accomplished by a buckle comprising a female part having a hollow body with a front wall, a back wall, an open top, a cavity between the top and bottom walls and at least one locking slot extending through the hollow body and communicating with the cavity. The top and bottom walls have a cutout that communicates with the open top. There is a male part that has a base, at least one locking leg and a central leg. The central leg has a shape that corresponds to the shape of the cutout in the female part. Inserting the male part into the open top of the female part causes the central leg to rest in the cutout of the female part and the locking leg to engage the locking slot to lock the male part to the female part.

In a preferred embodiment, there are two cutouts and two locking slots in the female part and two locking legs in the male part.

The central leg preferably has a thin mesh portion comprising a plurality of holes extending therethrough to create a screen-like appearance. This mesh portion reduces the weight of the buckle without reducing its strength and durability, and also gives the buckle a pleasing appearance. The thickness of the mesh portion is preferably less than half the thickness of the rest of the central leg of the male part.

In a preferred embodiment, the cutout and central leg have a triangular shape. This allows the male portion to be easily inserted into the female portion, even if the male portion is initially not perfectly straight. The male portion can be skewed slightly as it is brought toward the female portion, but the slanted triangular sides of the central leg and mating cutout serve to align the male portion in the proper position. This feature is especially useful in situations where the buckle is moving while being locked. This is especially important if the buckle is being worn on a backpack or article of clothing, because the wearer is often engaged in activities where precise positioning of the male portion is not easily attainable.

There are preferably strap-retaining bars disposed on at least one of the male and female parts, to allow a strap to be connected to said at least one of the male and female parts.

There is preferably a tab located on a free end of the locking leg for engaging the locking slot to lock the male part to the female part, Pressing on the tab releases the male part from the female part.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
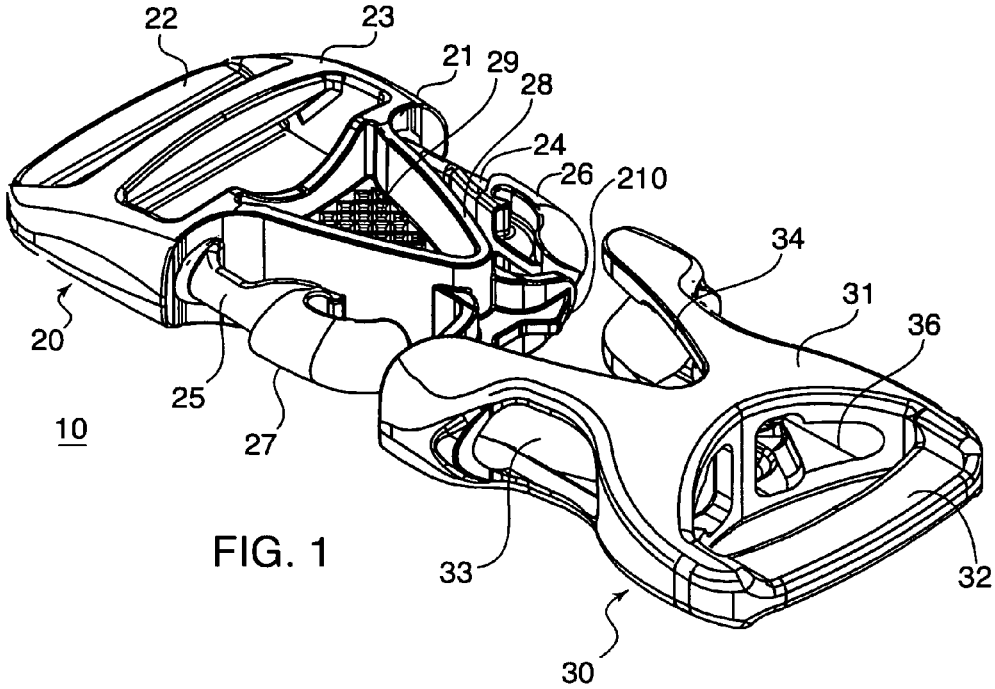
FIG. 1 shows a perspective view of a preferred embodiment of the buckle in a released position.
Figure 2:
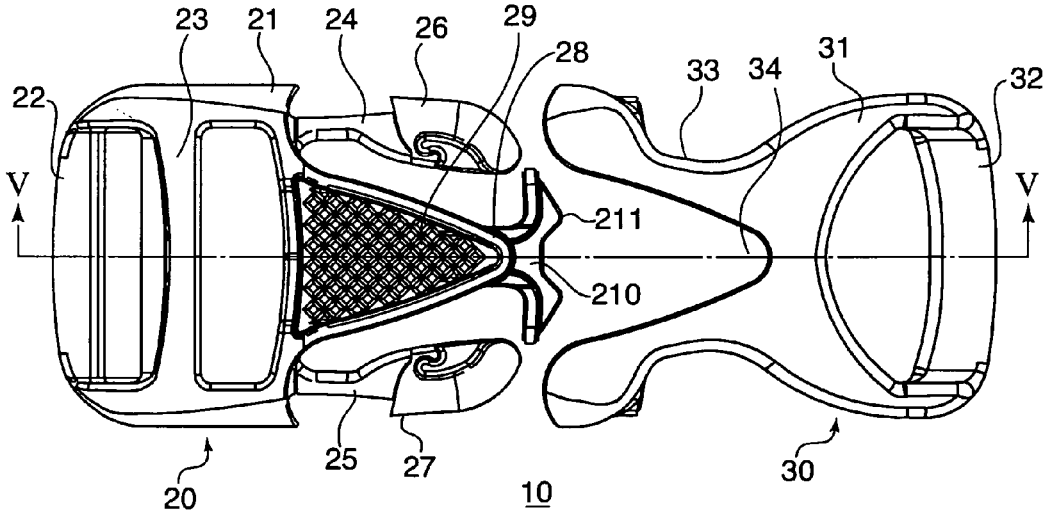
FIG. 2 shows a top view of the embodiment of FIG. 1.
Figure 3:
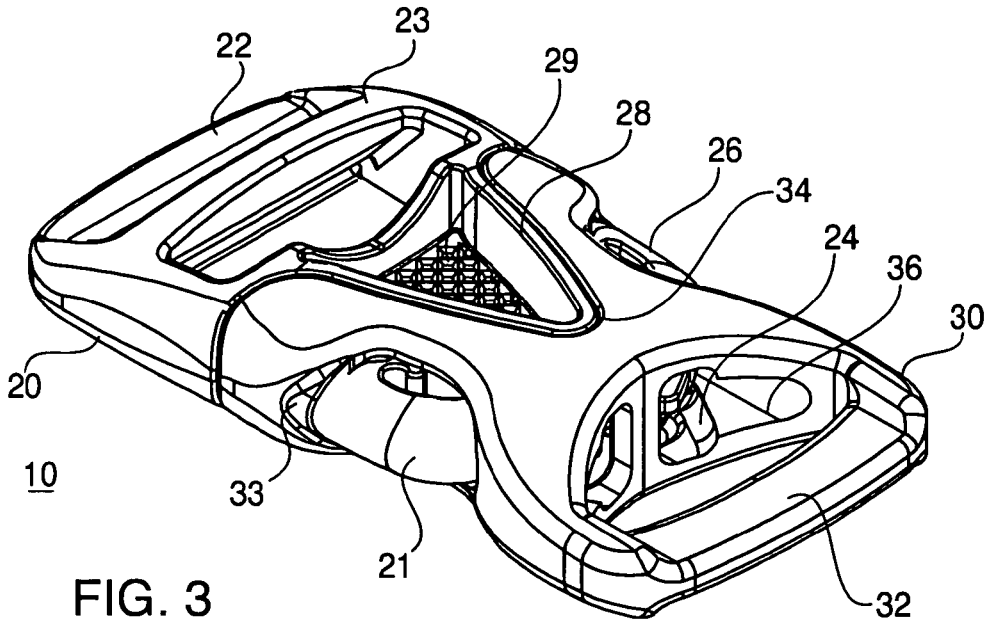
FIG. 3 shows a perspective view of the embodiment of FIG. 1 in a locked position.
Figure 4:
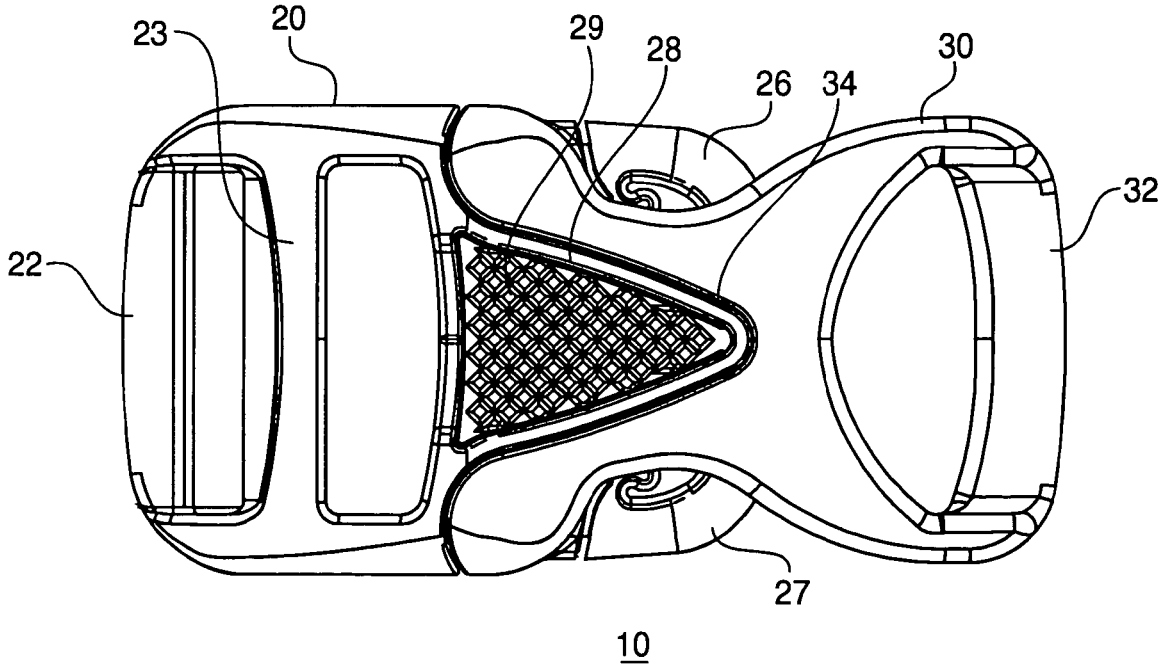
FIG. 4 shows a top view of the embodiment of FIG. 1 in a locked position.
Figure 5:
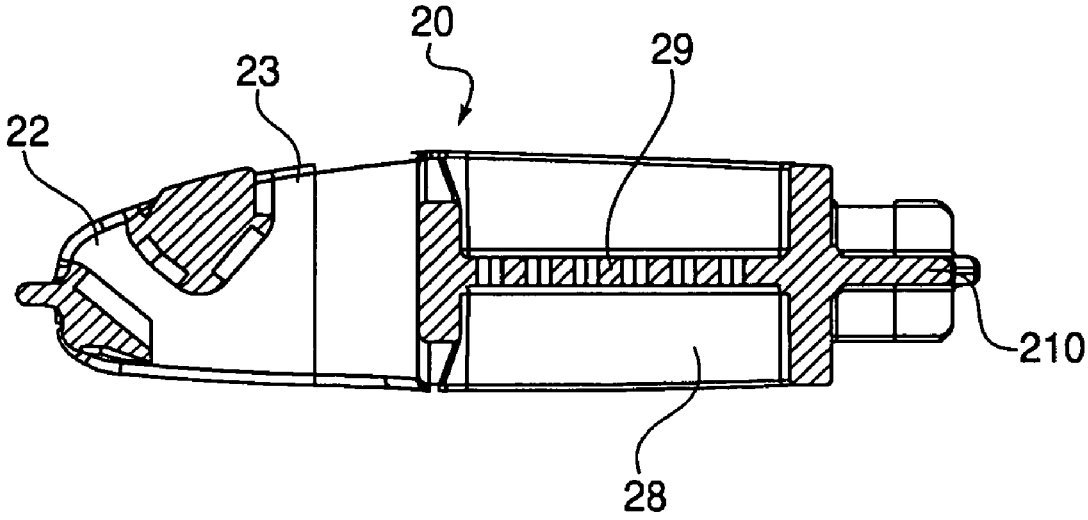
FIG. 5 shows a cross-sectional view of the male portion along lines V—V of FIG. 2.

Referring now in detail to the drawings, FIGS. 1–5 show buckle 10 according to the invention. Buckle 10 comprises a male portion 20 and a female portion 30. Male portion 20 has a base 21, strap retaining bars 22, 23, locking legs 25 with release tabs 26, 27, and a central leg 28. Central leg 28 is wider at its end attached to base 21, and tapers to a point at its free end. The sides of central leg 28 are thus sloped to allow central leg 28 to be easily inserted into female portion 30, even if it is not perfectly aligned. Central leg 28 has a central portion formed of a mesh or screen 29. Screen 29 is integrally molded with central leg 28 and has a much lower thickness than the outside edges of central leg 28, as shown in FIG. 5. This reduces the weight of the buckle, but the configuration of the mesh is such that the strength and durability of the buckle are not compromised.

Female part 30 has a main body 31, a strap retaining bar 32, locking slots 33 and a V-shaped cutout 34, for receiving male part 20. As male part 20 is inserted into female part 30, release tabs 26, 27 snap into locking slots 33 to lock male portion 20 into female portion 30. At the same time, central leg 28 slides into and fits between V-shaped cutout 34 on female part 30. At the free end of central leg 28, there is a foot structure 210, having protrusions 211. Foot structure 210 fits into an aperture 36 that extends through the far end of female part 30, to further secure male part 20 to female part 30.

Buckle 10, due to the configuration of central leg 28, is lightweight, secure and easily operated, even while the user is moving.

Accordingly, while only a single embodiment of the present invention has been shown and described, it is obvious that many changes and modifications may be made thereunto without departing from the spirit and scope of the invention.

What is claimed is:

1. A buckle comprising:

a female part having a hollow body with a front wall, a back wall an open top, a cavity between the front and back walls and at least one locking slot extending through the hollow body and communicating with the cavity, wherein the front and back walls each have a cutout that communicates with said open top, each said cutout having a shape that is wider at the open top than at an opposite end of said cutout; and a male part having a base, at least one locking leg and a central leg, said central leg having a shape corresponding to the shape of the cutouts in the female part, wherein inserting the male part into the open top of the female part causes the central leg to rest in the cutouts of the female part and the at least one locking leg to engage the at least one locking slot to lock the male part to the female part; and wherein during insertion of the male part into the female part, said cutouts align the male part with the female part to allow the male part to be inserted into the female part even when the male part is skewed relative to the female part as the male part is brought toward the female part.

2. The buckle according to claim 1, wherein there are two cutouts and two locking slots in the female part and two locking legs in the male part.

3. The buckle according to claim 1, wherein the central leg has a mesh portion comprising a plurality of holes extending therethrough.

4. The buckle according to claim 3, wherein the mesh portion has a thickness that is less than a thickness of the rest of the central leg.

5. The buckle according to claim 3, wherein the mesh portion is integrally formed with the central leg.

6. The buckle according to claim 1, wherein the cutouts and central leg have a triangular shape.

7. The buckle according to claim 1, further comprisang strap-retaining bars disposed on at least one of the male and female parts, to allow a strap to be connected to said at least one of the male and female parts.

8. The buckle according to claim 1, wherein there is a tab located on a free end of said at least one locking leg, said tab engaging the locking slot to lock the male part to the female part, and wherein pressing on the tab releases the male part from the female part.

9. The buckle according to claim 8, wherein a length of each cutout in the female part and the central leg of the male part are greater than a distance from the open top of the female part and an engagement area of the locking slot.

* * * * *